United States Patent [19]

Bishop

[11] Patent Number: 4,596,281

[45] Date of Patent: Jun. 24, 1986

[54] MOLD CORE AND METHOD OF FORMING INTERNAL PASSAGES IN AN AIRFOIL

[75] Inventor: Thomas H. Bishop, Alliance, Ohio

[73] Assignee: TRW Inc., Cleveland, Ohio

[21] Appl. No.: 414,041

[22] Filed: Sep. 2, 1982

[51] Int. Cl.[4] ..... B22C 9/10; B22D 33/04

[52] U.S. Cl. ..... 164/32; 164/137; 164/369; 164/370; 164/397; 164/122.1

[58] Field of Search ..... 164/30–32, 164/137, 340, 369, 370, 411, 397–399, 122.1

[56] References Cited

U.S. PATENT DOCUMENTS

| | | | |
|---|---|---|---|
| 1,404,250 | 1/1922 | Walther . | |
| 2,096,679 | 10/1937 | Gibson | 164/399 |
| 2,362,745 | 11/1944 | Davidson | 164/135 |
| 2,392,968 | 1/1946 | Bell | 249/124 |
| 3,029,485 | 4/1962 | McCormick . | |
| 3,401,738 | 9/1968 | Parille | 164/353 |
| 3,596,703 | 8/1971 | Bishop | 164/132 |
| 3,659,645 | 5/1972 | Rose | 164/353 |
| 3,662,816 | 5/1972 | Bishop et al. | 164/366 |

FOREIGN PATENT DOCUMENTS

| | | |
|---|---|---|
| 115370 | 4/1936 | Japan . |
| 47-40174 | 10/1972 | Japan . |
| 55-12340 | 4/1980 | Japan . |
| 926399 | 5/1963 | United Kingdom . |
| 941250 | 11/1963 | United Kingdom . |

*Primary Examiner*—Kuang Y. Lin

*Attorney, Agent, or Firm*—Yount & Tarolli

[57] ABSTRACT

An improved core is adapted to extend axially through the central portion of a mold cavity in which an airfoil or other article is formed. The core is used to form cooling passages as the airfoil is cast in the mold cavity. The core has an elongated cantilevered center section which is disposed within a main or base section. A metallic pin member extends from a free end portion of the cantilevered center section of the core to the main section of the core to hold the free end portion of the cantilevered center section against movement relative to the main section.

6 Claims, 11 Drawing Figures

MOLD CORE AND METHOD OF FORMING INTERNAL PASSAGES IN AN AIRFOIL

BACKGROUND OF THE INVENTION

The present invention relates to a mold core and the method by which it is used to form internal passages in a cast article, such as an airfoil.

Cores have been used to form passages in airfoils in a manner generally similar to that disclosed in U.S. Pat. Nos. 2,362,745; 3,401,738; 3,659,645; 3,596,703 and 3,662,816. The cores are positioned relative to airfoil mold cavities by pin members. These pin members extend from the molds into engagement with the cores.

Cores of a ceramic material have been formed with a relatively long length and small transverse cross sectional area. These cores are easily broken during handling in a foundry. In addition, there is a tendency for sections of a core to shift relative to each other during forming of a pattern and mold and during casting of an airfoil.

SUMMARY OF THE PRESENT INVENTION

The present invention provides a new and improved core which is used to form passages in a cast metal article, such as an airfoil. One or more metallic pin members extend between ceramic sections of the core to hold the sections against movement relative to each other. Thus, opposite end portions of the pin member are embedded in the core sections. An intermediate portion of the pin member extends across the space between the core sections.

When the core is to be used in casting an article, the core is first encased in a wax pattern having a configuration corresponding to the configuration of the article. The wax pattern is then covered with ceramic mold material. The wax pattern material is subsequently removed from the mold by heating the mold or using a suitable solvent. After the mold has been fired, it is preheated and molten metal is poured into the mold.

During forming of the pattern, covering the pattern with mold material, preheating of the mold and pouring of molten metal, the pin member prevents relative movement between sections of the core. When molten metal is poured into the mold, the metal melts an exposed intermediate portion of the pin member. The end portions of the pin member are embedded in the core material and become fused with the molten metal as it solidifies. When the core is subsequently removed from the cast article, the end portions of the pin member project into space in the article. These end portions of the pin member may be removed if desired.

Accordingly, it is an object of this invention to provide a new and improved core which is used to form passages in a cast metal article, such as an airfoil, and wherein the core includes a pin member having end portions embedded in spaced apart sections of the core to hold them against movement relative to each other.

Another object of this invention is to provide a new and improved mold structure which encloses a ceramic core and wherein sections of the core are held against movement relative to each other by a pin member which extends between the sections.

Another object of this invention is to provide a new and improved method of forming an airfoil having internal passages by providing a ceramic core having sections which are held against movement relative to each other by a pin, enclosing the core in a ceramic mold, melting a portion of the pin with molten metal which is poured into mold, and, subsequently, removing the ceramic core from the airfoil to leave end portions of the pin extending in opposite directions from metal solidified in a space between the core sections.

BRIEF DESCRIPTION OF THE DRAWINGS

The foregoing and other objects and features of the present invention will become more apparent upon a consideration of the following description taken in conjunction with the accompanying drawings, wherein.

DESCRIPTION OF ONE SPECIFIC PREFERRED EMBODIMENT OF THE INVENTION

Figure 1:
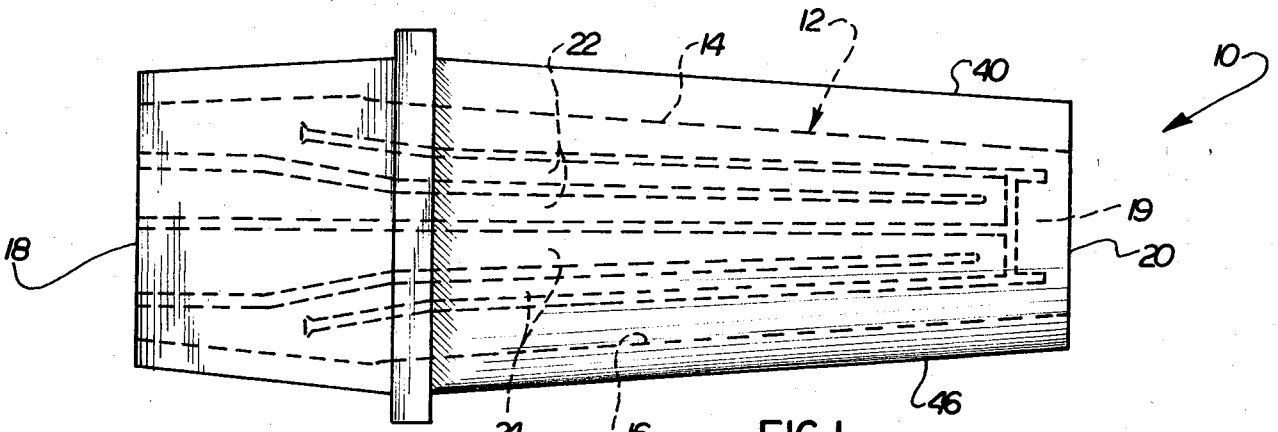
FIG. 1 is a somewhat schematicized illustration of an airfoil having internal passages.

An airfoil 10 having an internal cooling passage system 12 is illustrated in FIG. 1. The cooling passage system 12 extends axially of the metal airfoil 10. The passage system 12 is used to conduct cooling fluid during operation of a jet engine.

Although the cooling fluid passage system 12 could have many different configurations, in the illustrated airfoil 10, the cooling passage system includes main passages 14 and 16 which extend between a root end portion 18 and a passage 19 at a tip end portion 20 of the airfoil 10. Central passages 22 and 24 are disposed between the main passages 14 and 16 and have an elongated U-shaped configuration. Therefore opposite ends of the cooling passages 22 and 24 are disposed adjacent to the root end portion 18 of the airfoil 10. Although the airfoil 10 could have many different constructions, it is generally similar to a CF6-80 second stage airfoil. However, it should be understood that the present invention can be used in conjunction with other types of airfoils.

Figure 2:
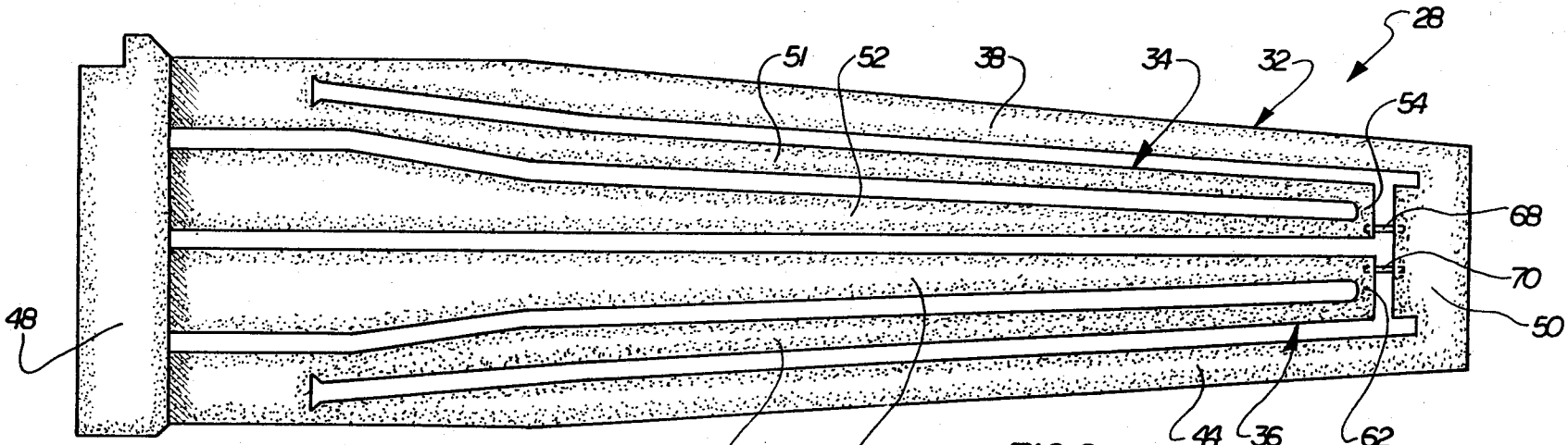
FIG. 2 is an enlarged plan view of a ceramic core used to form the internal passages in the airfoil of FIG. 1.

A one-piece ceramic core 28 used to form the cooling passage system 12 in the airfoil 10, is illustrated in FIG. 2. The ceramic core 28 can be made of many different ceramic core materials, such as the material disclosed in U.S. Pat. No. 4,164,424. The ceramic core 28 has a main or base section 32 which is used to form the cooling passages 14, 16 and 19. The main section 32 extends around a pair of cantilevered center sections 34 and 36. The cantilevered center sections 34 and 36 are used to form the cooling passages 22 and 24.

The main section 32 of the one-piece ceramic core 28 includes an elongated edge section 38 which forms the passage 14 adjacent to the trailing edge portion 40 (see FIG. 1) of the airfoil 10. Similarly, an elongated edge section 44 forms the passage 16 adjacent to the leading edge portion 46 of the airfoil 10. The edge sections 38 and 44 (FIG. 2) of the core 28 are interconnected at opposite end sections 48 and 50. The end sections 48 and 50 advantageously form core prints which are used to position the core 28 in a mold.

The cantilevered center section 34 of the ceramic core 28 is integrally formed with the main section 32. Thus, the cantilevered center section 34 includes a pair of generally parallel arms 51 and 52 which are fixedly connected with the end section 48 of the core. The free ends of the arms 51 and 52 are interconnected by a short connector section 54. This results in the cantilevered center section 34 of the core 28 having an elongated U-shaped configuration to form the passage 22 (FIG. 1) in the airfoil 10.

Similarly, the cantilevered center section 36 of the ceramic core 28 includes a pair of generally parallel arms 58 and 60 which extend axially outwardly from the end section 48. The free ends of the arms 58 and 60 are interconnected by a short connector section 62. This results in the cantilevered center section 36 of the core having an elongated U-shaped configuration corresponding to the configuration of the passage 24 in the airfoil 10.

Figure 3:
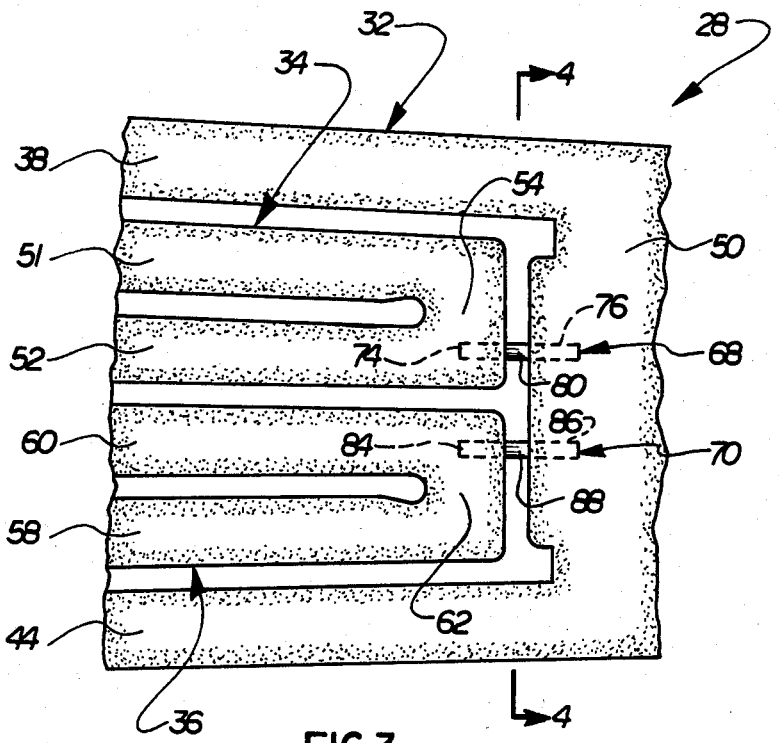
FIG. 3 is an enlarged fragmentary sectional view of a portion of the ceramic core of FIG. 2 and illustrating the relationship between sections of the core and pins which hold the sections against movement relative to each other.
Figure 4:
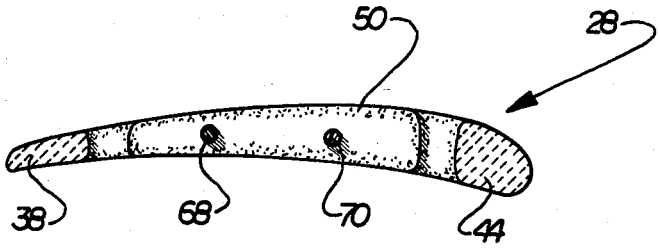
FIG. 4 is a fragmentary sectional view, taken generally along the line 4—4 of FIG. 3, further illustrating the relationship between the pins and core sections.

Due to the relatively long, thin configuration of the edge sections 38 and 44 and arms 51, 52, 58 and 60, the one-piece ceramic core 28 is very fragile and prone to breakage. The susceptibility of the core 28 to breakage is increased by the cantilevered construction of the center sections 34 and 36. In accordance with a feature of the present invention, the free end portions of the cantilevered center sections 34 and 36 are held against movement relative to the main section 32 of the one-piece ceramic core 28 by a pair of metallic pins 68 and 70 (see FIGS. 3 and 4).

The cylindrical pin 68 has an inner end portion 74 (FIG. 3) which is embedded in the ceramic material of the arm 52 of the center section 34. An opposite end portion 76 of the pin 68 is embedded in the ceramic material of the end section 50 of the ceramic core 28. The space between the free end portion of the arm 52 and the end section 50 is spanned by an intermediate portion 80 of the pin 68.

Similarly, the pin 70 has end portions 84 and 86 which are embedded in the arm 60 and end section 50. The space between the free end of the arm 60 and end section 50 is spanned by an intermediate portion 88 of the pin 70. Although the end portions 74, 76, 84 and 86 of the pins 68 and 70 have been described herein as being cylindrical, it is contemplated the end portions of the pins could be flattened. Flattening the end portions 74, 76, 84 and 86 of the pins 68 and 70 facilitates locating the pins during forming of the ceramic core 28.

The pins 68 and 70 (FIGS. 3 and 4) increase the strength of the core 28 to enable it to withstand forces to which it is subjected during processing in a foundry. The pins 68 and 70 are formed of a metal which is compatible with the metal of which the airfoil 10 (FIG. 1) is formed. In one specific instance, the cylindrical pins 68 and 70 were formed of platinum and had a diameter of 0.02 inches. The diameter of the platinum wire used to form the pins 68 and 70 may be reduced if desired in order to reduce the cost of the pins. Of course, reducing the diameter of the pins effects a corresponding reduction in the strength of the pins.

Figure 5:
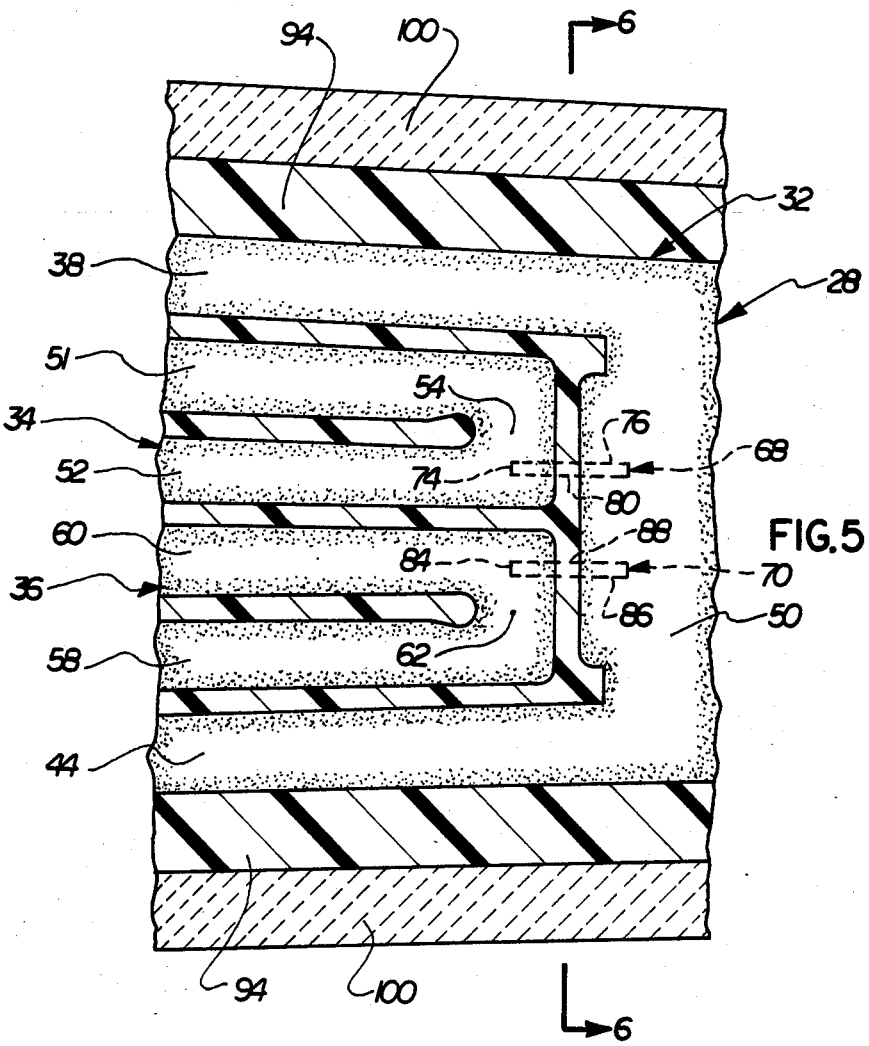
FIG. 5 is a fragmentary sectional view, generally similar to FIG. 3, illustrating the relationship between the core, a wax pattern and a ceramic mold formed over the wax pattern.
Figure 6:
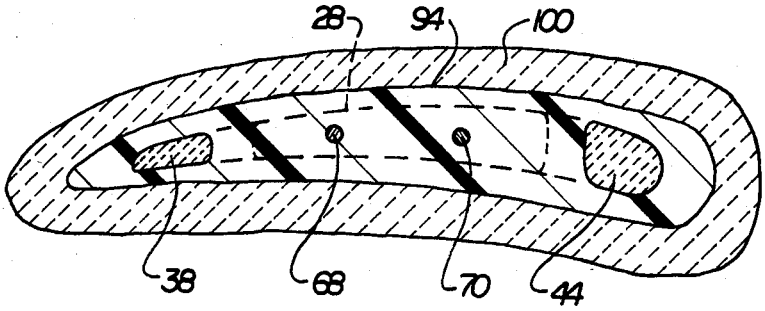
FIG. 6 is a sectional view, taken generally along the line 6—6 of FIG. 5, further illustrating the relationship between the core, wax pattern, and mold.

When the core 28 is to be used in forming passages in the metal airfoil 10, a wax pattern 94 (see FIGS. 5 and 6) having the same configuration as the airfoil is formed around the core. To form the wax pattern 94, the core 28 is first positioned in a pattern forming cavity having a configuration corresponding to the configuration of the airfoil 10. Hot wax is injected under pressure into the pattern forming cavity and flows into the spaces around the core 28 to completely fill the pattern forming cavity. This results in the wax flowing into the spaces between the arm sections 38, 44, 51, 52, 58 and 60 of the core 28. In addition, the wax flows into the space between the free end portions of the cantilevered center sections 34 and 36 and the main section 32 of the core. This results in the wax engaging the exposed intermediate sections 80 and 88 of the pins 68 and 70. Of course, the end portions 74, 76, 84 and 86 of the pins 68 and 70 are embedded in the ceramic core sections 34, 36 and 50 and are not engaged by the wax.

When the hot wax is being injected under pressure into the pattern mold cavity, the wax applies hydraulic forces against the ceramic core 28. These forces tend to deflect the free end portions of the center sections 34 and 36 of the core 28 relative to the base section 32 of the core. However, the pins 68 and 70 hold the free end portions of the cantilevered center sections 34 and 36 against movement relative to the base sections 32 of the core. This tends to prevent breaking of the core at the fixed end portions of the cantilevered center sections 34 and 36. In addition, the pins 68 and 70 maintain the desired spatial relationship between the cantilevered center sections 34 and 36 and the main section 32 of the core 28.

Once the hot pattern wax has cooled, the pattern 94 is removed from the pattern forming cavity and is used in the subsequent forming of a ceramic mold. Thus, the pattern 94 is covered with a plurality of layers of ceramic mold material. These layers may be applied to the pattern by repetitively dipping the pattern in ceramic mold material having a known composition which may be similar to the compositions disclosed in U.S. Pat. Nos. 2,961,751 or 4,066,166. However, other methods of applying other ceramic mold materials to the pattern could be used if desired.

The application of ceramic mold material results in the wax pattern 94 and core 28 being enclosed to form a ceramic mold 100 in a known manner. The end portions 48 and 50 (see FIG. 2) of the core 28 are engaged by the mold 100 to firmly anchor opposite ends of the core against movement relative to the mold.

Figure 7:
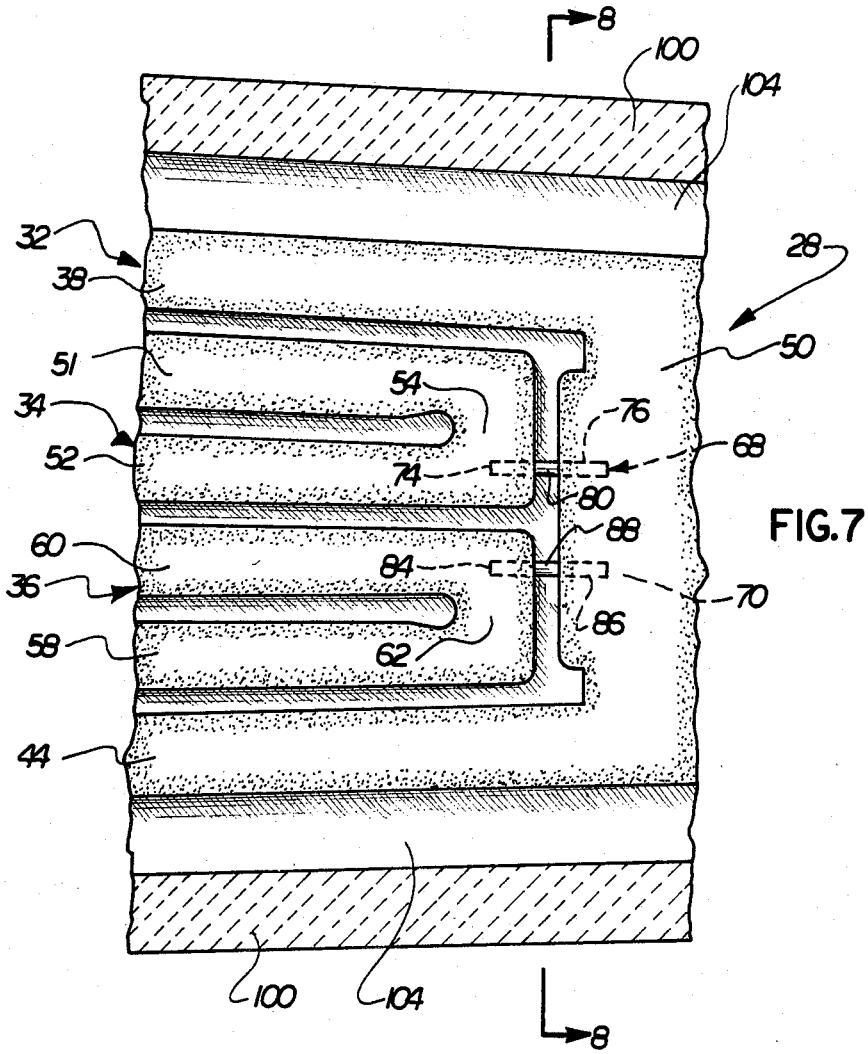
FIG. 7 is a fragmentary sectional view, generally similar to FIG. 5, illustrating the relationship between the core and a mold cavity after the wax pattern has been removed from the mold.
Figure 8:
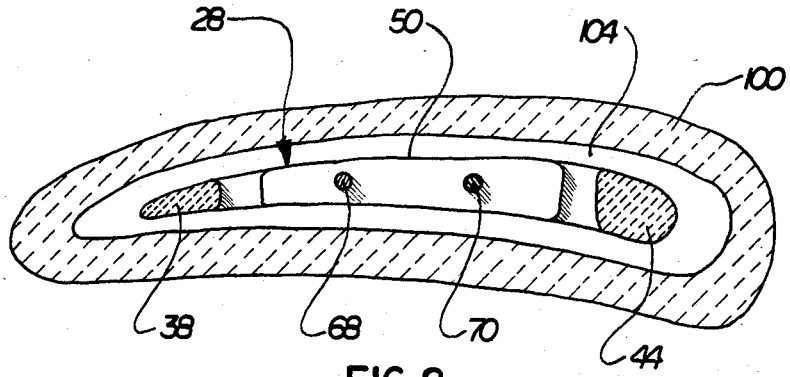
FIG. 8 is a sectional view, taken generally along the line 8—8 of FIG. 7, further illustrating the relationship between the core and mold cavity.

Once the ceramic mold 100 has dried, the wax pattern 94 is removed from the mold. This can be accomplished by firing the mold 100 and draining the molten wax out of the mold. Once the wax pattern 94 has been removed from the mold 100 (see FIGS. 7 and 8), a mold cavity 104 (FIGS. 7 and 8) having the same configuration as the airfoil 10 is formed in the mold. The core 28 extends axially through the center portion of the mold cavity (FIG. 8). The core 28 is held in place by engagement of the end portions 48 and 50 (FIG. 2) of the core with the mold 100.

The pins 68 and 70 (FIG. 7) hold the cantilevered center sections 34 and 36 of the core against movement relative to the base section 28 during removal of the pattern material and firing of the mold. Of course, once the wax pattern 94 has been removed from the mold 100, space is provided between the arms 38, 44, 51, 52, 58 and 60 of the core 28 (see FIG. 7). In addition, space is also provided between the free end portions of the cantilevered center sections 34 and 36 and the end section 50 of the core. The pins 68 and 70 extend across the space between the free end portions of the cantilevered center sections 34 and 36 and the end section 50 of the core so that the intermediate portions 80 and 88 of the pins are again exposed.

Once the wax pattern 94 has been removed and the mold 100 fired, the mold is ready to be used to cast an airfoil. When this is done, the mold 100 and core 28 are preheated to a temperature which is below the melting point of the pins 68 and 70.

Molten metal to form the airfoil 10 is then poured into the mold 100. Although the molten metal could have any desired composition, it may have a composition similar to the composition disclosed in U.S. Pat. Nos. 3,260,505 or 3,711,337. The molten metal flows around the core 28, which is spaced apart from the side surface of the mold, into the space between the arm sections 38, 44, 51, 52, 58 and 60 of the core. In addition, the molten metal flows into the space between the free end portions of the cantilevered center sections 34 and 36 and the end sections 50 of the core.

As the molten metal flows into the space between the cantilevered center sections 34 and 36 and the end section 50 (FIG. 7), the molten metal engages the intermediate portions 80 and 88 of the pins 68 and 70. This results in the intermediate portions 80 and 88 of the pins 68 and 70 being melted and dissolved in the molten metal which forms the airfoil. The end portions 74, 76, 84 and 86 of the pins 68 and 70 are embedded in the cantilevered center sections 34 and 36 and the end section 50 of the core 28 and are not exposed to the molten metal. Therefore, the end portions 74, 76, 84 and 86 of the pins 68 and 70 remain intact and become fused with the solidifying metal between the free end portions of the center sections 34 and 36 and the end section 50.

Once the molten metal in the mold cavity 104 has solidified, the airfoil 10 is removed from the mold 100. The material forming the core 28 is then removed from the airfoil 10 to open the cooling passage system 12 in the airfoil (see FIGS. 9 and 10). When the core material is removed, the end portions 74, 76, 84 and 86 of the pins 68 and 70 extend outwardly from an internal wall or ridge 112 (FIGS. 9 and 11) of the airfoil into the cooling passages.

Figure 9:
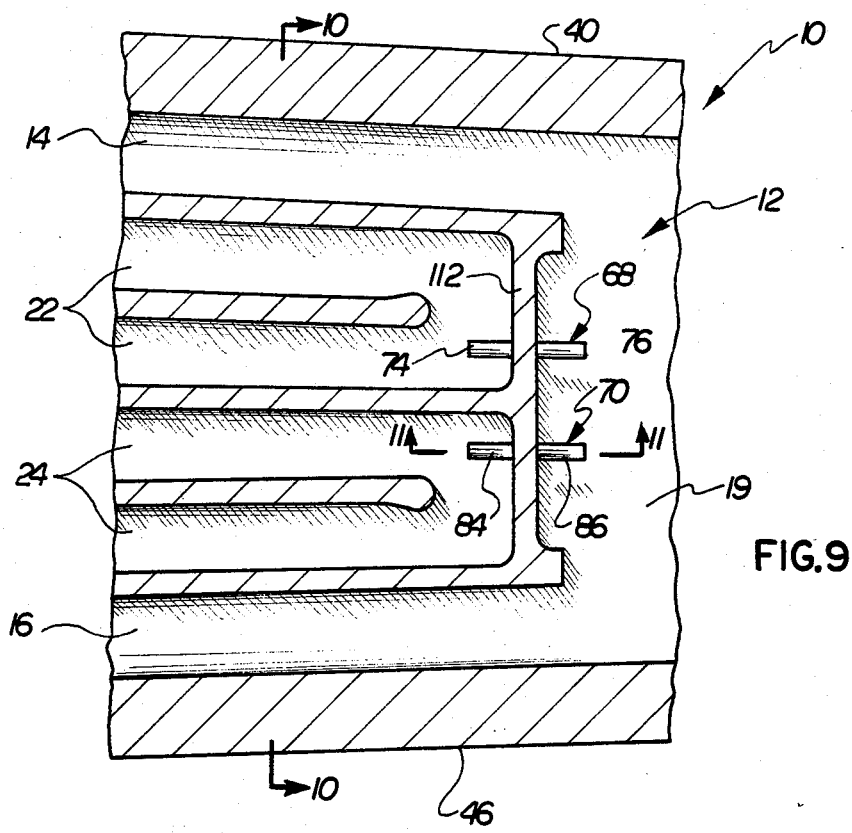
FIG. 9 is an enlarged fragmentary sectional view of a portion of the airfoil of FIG. 1 and illustrating internal passages formed in the portion of the mold cavity shown in FIG. 7.
Figure 10:
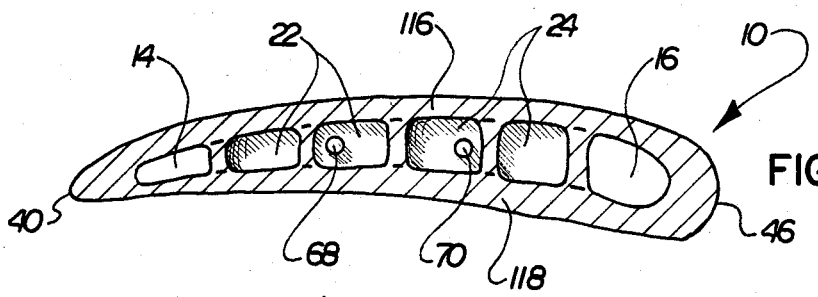
FIG. 10 is a sectional view taken along the line 10—10 of FIG. 9.
Figure 11:
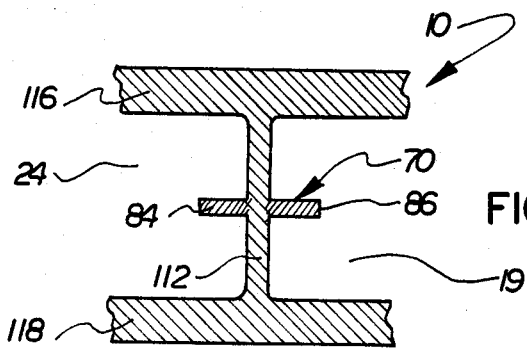
FIG. 11 is an enlarged fragmentary sectional view, taken generally along the line of 11—11 of FIG. 9, illustrating the relationship between the airfoil and end portions of a core pin.

When the core 28 is removed from the airfoil 10, the end portions 84 and 86 of the pin 70 extend outwardly from rib or wall 112 in the airfoil 10 into the cooling passage 24 and the end passage 19 in the manner shown in FIGS. 9 and 11. It should be noted that the outwardly projecting end portions 84 and 86 of the pin 70 are spaced from the major sides 116 and 118 of the airfoil (FIG. 11). Similarly, the end portions 74 and 76 of the pin 68 extend outwardly from the wall 112 into cooling passages 22 and 19 (see FIG. 9).

The end portions 74, 76, 84 and 86 of the pins 68 and 70 can be removed from the interior of the airfoil 10 by any desired method. Specifically, the end portions of the pins 68 and 70 could be removed by liquid honing in which an abrasive laden semi-solid grinding media is forced through the cooling passages. Alternatively, the end portions of the pins 68 and 70 could be removed by inserting a suitable cutting tool into the cooling passages. However, it is contemplated that the effect of the end portions of pins 68 and 70 on the operating characteristics of the blade 10 may be negligible and the end portions of the pins may be left in place if desired.

In view of the foregoing description, it is apparent that the present invention provides a new and improved core 28 which is used to form passages 14, 16, 19, 22 and 24 in a cast metal article, such as an airfoil 10. Metallic pin members 68 and 70 extend between ceramic sections 32, 34 and 36 of the core 28 to hold the sections against movement relative to each other. Thus, opposite end portions 74 and 76 of the pin member 68 are embedded in the core sections 32 and 34. An intermediate portion 80 of the pin member 68 extends across the space between the core sections 32 and 34.

When the core 28 is to be used in casting an article, such as the airfoil 10, the core is first encased in a wax pattern 94 having a configuration corresponding to the configuration of the article. The wax pattern 94 is then covered with ceramic mold material 100. The wax pattern 94 is subsequently removed from the mold 100 by heating the mold or using a suitable solvent. After the mold 100 has been fired, it is preheated and molten metal is poured into the mold.

During forming of the pattern 94, covering the pattern with mold material 100, preheating of the mold and pouring of molten metal, the pin member 68 prevents relative movement between sections 32 and 34 of the core 28. When molten metal is poured into the mold 100, the metal melts an exposed intermediate portion 80 of the pin member 68. The end portions 74 and 76 of the pin member 68 are embedded in the core material and become fused with the molten metal as it solidifies. When the core 28 is subsequently removed from the cast article, the end portions 74 and 76 of the pin member 68 project into space in the article. These end portions 74 and 76 of the pin member 68 may be removed if desired.

Having described a specific preferred embodiment of the invention, the following is claimed:

1. A core for use in forming passages in a cast metal article, said core comprising a plurality of ceramic core sections including first and second ceramic core sections which are spaced apart from each other, and pin means for holding said first and second ceramic core sections against movement relative to each other, said pin means including a metallic pin member having a first metallic end portion embedded in said first ceramic core section, a second metallic end portion embedded in said second ceramic core section and a metallic intermediate portion extending across the space between said first and second core sections.

2. A core as set forth in claim 1 wherein said first ceramic core section has an elongated configuration and is cantilevered by having a fixed end portion connected with one of said plurality of core sections and a free end portion disposed adjacent to said second core section, said metallic pin member extending between said free end portion of said first core section and said second core section.

3. A mold structure comprising a ceramic core having first and second core sections which are spaced apart from each other, pin means for holding said first and second ceramic core sections against movement relative to each other, said pin means including a metallic pin member having a first metallic end portion embedded in said first ceramic core section, a second metallic end portion embedded in said second ceramic core section and a metallic intermediate portion extending across the space between said first and second core sections, and a ceramic mold body at least partially enclosing said ceramic core to form a mold cavity which is adapted to receive molten metal and in which at least a portion of said ceramic core is disposed, said metallic pin member being spaced apart from said ceramic mold body.

4. A method of forming a cast metal airfoil having internal passages, said method comprising the steps of providing a ceramic core having first and second sections which are spaced apart from each other and have configurations corresponding to the configurations of portions of the internal passages, holding the first and second sections of the ceramic core against movement relative to each other with a metal pin having a first portion embedded in the first core section, a second portion embedded in the second core section and an intermediate portion extending across the space between the first and second core sections, at least partially enclosing the core in a portion of a mold cavity having a configuration corresponding to the configuration of the airfoil, flowing molten metal into the mold cavity, melting the intermediate portion of the pin with the molten metal, solidifying the molten metal to form the airfoil, and removing the ceramic core with the first and second end portions of the pin extending in opposite directions from metal solidified between the first and second core sections.

5. A method as set forth in claim 4 further including the step of removing the first and second end portions of the pin from within the airfoil.

6. A method as set forth in claim 4 further including the step of at least partially encasing the ceramic core in body of wax having a configuration corresponding to the configuration of the airfoil, said step of encasing the ceramic core in a body of wax including surrounding an outer side surface of the intermediate portion of the pin with wax, said step of at least partially enclosing the core in a portion of a mold cavity including applying a covering of ceramic mold material over the body of wax, said method further including the step of removing the body of wax from the covering of ceramic mold material prior to performing said step of flowing molten metal into the mold cavity.

* * * * *